US011831074B1

(12) United States Patent
Kim et al.

(10) Patent No.: US 11,831,074 B1
(45) Date of Patent: Nov. 28, 2023

(54) ANTENNA DEVICE FOR SUPPRESSING SIDELOBE

(71) Applicant: AGENCY FOR DEFENSE DEVELOPMENT, Daejeon (KR)

(72) Inventors: Seung Ho Kim, Daejeon (KR); Byung Chul Park, Daejeon (KR); Kun Sup Kwon, Daejeon (KR); Jong Wan Heo, Daejeon (KR); Sung Jae Lee, Daejeon (KR); Ki Min Hwang, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 17/977,331

(22) Filed: Oct. 31, 2022

(51) Int. Cl.

| | |
|---|---|
| ***H01Q 15/16*** | (2006.01) |
| ***H01Q 13/02*** | (2006.01) |
| ***H01Q 21/28*** | (2006.01) |
| ***H01Q 1/42*** | (2006.01) |

(52) U.S. Cl.
CPC ..... *H01Q 15/16* (2013.01); *H01Q 1/421* (2013.01); *H01Q 13/02* (2013.01); *H01Q 21/28* (2013.01)

(58) Field of Classification Search
CPC ..... H01Q 1/421; H01Q 13/02; H01Q 15/16; H01Q 21/28
See application file for complete search history.

(56) References Cited

U.S. PATENT DOCUMENTS

| | | | | |
|---|---|---|---|---|
| 5,604,508 | A * | 2/1997 | Atkinson | H01Q 1/125 343/893 |
| 2005/0140563 | A1 | 6/2005 | Eom et al. | |
| 2011/0030015 | A1* | 2/2011 | King | H01Q 1/125 343/906 |
| 2014/0225796 | A1* | 8/2014 | Chen | H01Q 15/0033 343/781 CA |
| 2015/0123854 | A1 | 5/2015 | Chakam et al. | |
| 2021/0320403 | A1* | 10/2021 | Shapoury | H01Q 1/362 |

FOREIGN PATENT DOCUMENTS

| | | | | |
|---|---|---|---|---|
| KR | 19940003118 | | 2/1994 | |
| KR | 20050066801 | A | 6/2005 | |
| KR | 20080087310 | A | 10/2008 | |
| KR | 20150022795 | A | 3/2015 | |
| KR | 101885659 | B1 | 8/2018 | |
| KR | 101943893 | B1 | 1/2019 | |
| WO | WO-2015007726 | A1 * | 1/2015 | H01Q 1/405 |

* cited by examiner

*Primary Examiner* — Graham P Smith
*Assistant Examiner* — Amal Patel
(74) *Attorney, Agent, or Firm* — MILES & STOCKBRIDGE P.C.

(57) ABSTRACT

The embodiments generally relate to an antenna device that includes a cover having a specific shape to suppress a sidelobe of an elevation angle gain pattern which is caused by a radio-frequency (RF) device regardless of an avoidance area.

6 Claims, 9 Drawing Sheets

ANTENNA DEVICE FOR SUPPRESSING SIDELOBE

FIELD OF THE INVENTION

The embodiments of the present invention generally relate to an antenna device for suppressing a sidelobe, and more particularly, to an antenna device that further includes a cover for improving a sidelobe of an elevation angle gain pattern which is caused by a radio-frequency ("RF") device disposed inside an avoidance area.

DISCUSSION OF THE RELATED ART

A parabolic offset antenna is widely used for transmission and/or reception of satellite signals. In conjunction with a parabolic offset antenna, a horn antenna is fixed at a location spaced apart from the parabolic offset antenna to supply power to the parabolic offset antenna. The structure for fixing the horn antenna often reduces antenna gain of the parabolic offset antenna, and/or causes an increase in the level of the sidelobe in the radiation pattern.

At the time of designing the parabolic offset antenna, design for suppression of the sidelobe as well as the reduction of antenna gain is required. However, in the design of the parabolic offset antenna, radio-frequency ("RF") devices relating to a transmitter and a receiver are installed at the side of a horn antenna support pedestal. Such RF devices may be configured to act as scatterers, which may result in an increase in the level of the sidelobe.

To address these drawbacks, an avoidance area that minimally affects an elevation angle gain pattern may be set by predicting scattered radio waves using a ray tracing technology. Based on positions and angles of the RF devices in consideration of the avoidance area, the design may be made. However, there may be a situation in which the RF devices may not be installed at the position designed in consideration of the avoidance area depending on an external environment. Even in such a situation, there is a need for a technique that does not affect the sidelobe of the elevation angle gain pattern of the antenna.

SUMMARY OF THE INVENTION

Accordingly, the embodiments of the present invention are directed to an antenna device for suppressing a sidelobe that substantially obviates one or more problems due to limitations and disadvantages of the related art.

An aspect is proposed in view of the above-described drawbacks in the related art, and the embodiments of the present disclosure generally relate to an antenna device that further includes a cover for improving a sidelobe of an elevation angle gain pattern, which is caused by a radio-frequency (RF) device disposed inside an avoidance area. Technical matters to be achieved in the present disclosure are not limited to the technical matters described above, and other technical matters will be inferred from the example embodiments.

According to the example embodiments, by disposing a cover of a specific shape above an RF device, a sidelobe of an elevation angle gain pattern is suppressed. Specifically, by disposing the cover of a specific shape above the RF device regardless of the inside or the outside of an avoidance area, the sidelobe of the elevation angle gain pattern is improved. For example, the cover has a pentagonal shape, and vertexes of the pentagon are located at the center of the base line of an isosceles triangle to scatter rays. This suppresses the sidelobe of the elevation angle gain pattern. By using the cover having such a structure, it is possible to use an antenna device in which the sidelobe of the elevation angle gain pattern are improved regardless of the position at which the RF device is disposed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the antenna device for suppressing a sidelobe includes an antenna device which includes: an offset parabolic curved surface in which a main reflector portion is provided based on a property of the offset parabolic curved surface, wherein the offset parabolic curved surface has one focal point, and a height of the focal point is lower than a height of a center of the reflector; a feed horn provided to face the offset parabolic curved surface at a preset position; a radio-frequency device; and a cover having a specific shape and disposed above the radio-frequency device.

According to another aspect, the specific shape may be a pentagonal shape.

According to another aspect, a base plane of the pentagonal shape may have a structure in which a rectangle and an isosceles triangle are coupled to each other.

According to another aspect, vertexes of the pentagonal shape may be located at a center of a base line of the isosceles triangle shared by the rectangle.

According to another aspect, the base plane of the pentagonal shape may be larger in size than the radio-frequency device.

According to another aspect, the feed horn may be configured to face a center of the offset parabolic curved surface without a sub-reflector.

According to another aspect, the feed horn may be configured to face a center of a cassegrain sub-reflector or a gregorian sub-reflector, and the cassegrain sub-reflector or the gregorian sub-reflector may be configured to face a center of the offset parabolic curved surface.

According to another aspect, the radio-frequency device and the cover may be located inside a preset avoidance area.

According to another aspect, the cover may be configured to suppress a sidelobe of an elevation angle gain pattern, which is caused by the radio-frequency device located inside the preset avoidance area.

It is to be understood that both the foregoing general description and the following detailed description are examples and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE EXEMPLARY EMBODIMENTS

Reference will now be made in detail to the embodiments of the present invention, examples of which are illustrated in the accompanying drawings.

Terms used in example embodiments are general terms that are currently widely used while their respective functions in the present disclosure are taken into consideration. However, the terms may be changed depending on the intention of one of ordinary skilled in the art, legal precedents, emergence of new technologies, and the like. Also, in particular cases, terms that are arbitrarily selected by the applicant of the present disclosure may be used. In this case, the meanings of these terms may be described in detail in the corresponding disclosure. Accordingly, the terms used herein should be defined based on the meanings thereof and the content throughout the specification, rather than a simple name of the term.

When a part "comprises or includes" a constituent element through the specification, this means that the part may further include other constituent elements, rather than excluding other constituent elements, unless other specified. In addition, the terms such as "part," "module" and the like used herein may refer to a unit that performs at least one function or operation, which may be realized as hardware or software, or may be realized as a combination of hardware and software.

The expression "at least one of a, b, and c" used herein may include the following meanings: 'a alone', 'b alone', 'c alone', 'both a and b together', 'both a and c together', 'both band c together', or 'all three of a, b, and c together'.

In the present disclosure, a "terminal" may be implemented as a computer or a portable terminal capable of accessing a learning device or another terminal through a network. Here, the computer may include, for example, a notebook, a desktop computer, and a laptop computer which are equipped with a web browser. The portable terminal may be a wireless communication device ensuring a portability and a mobility, and include any type of handheld wireless communication device, for example, a communication-based terminal such as international mobile telecommunication (IMT), code division multiple access (CDMA), W-code division multiple access (W-CDMA), long term evolution (LTE), or the like, a smartphone, a tablet personal computer (PC), and the like.

In the following description, embodiments of the present disclosure will be described in detail with reference to the accompanying drawings so that those skilled in the art can easily carry out the present disclosure. The present disclosure may be embodied in many different forms and is not limited to the example embodiments described herein. Hereinafter, example embodiments of the present disclosure will be described in detail with reference to the drawings.

Figure 1A:
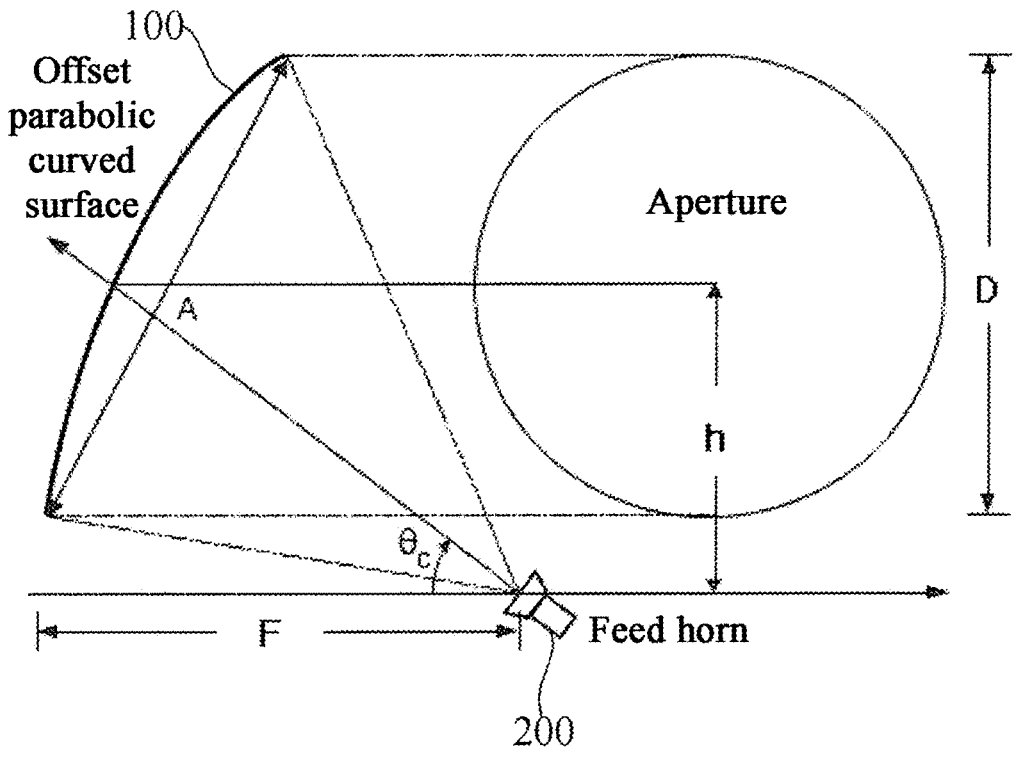
FIG. 1A illustrates a geometry of an offset parabolic antenna according to an example embodiment.
Figure 1B:
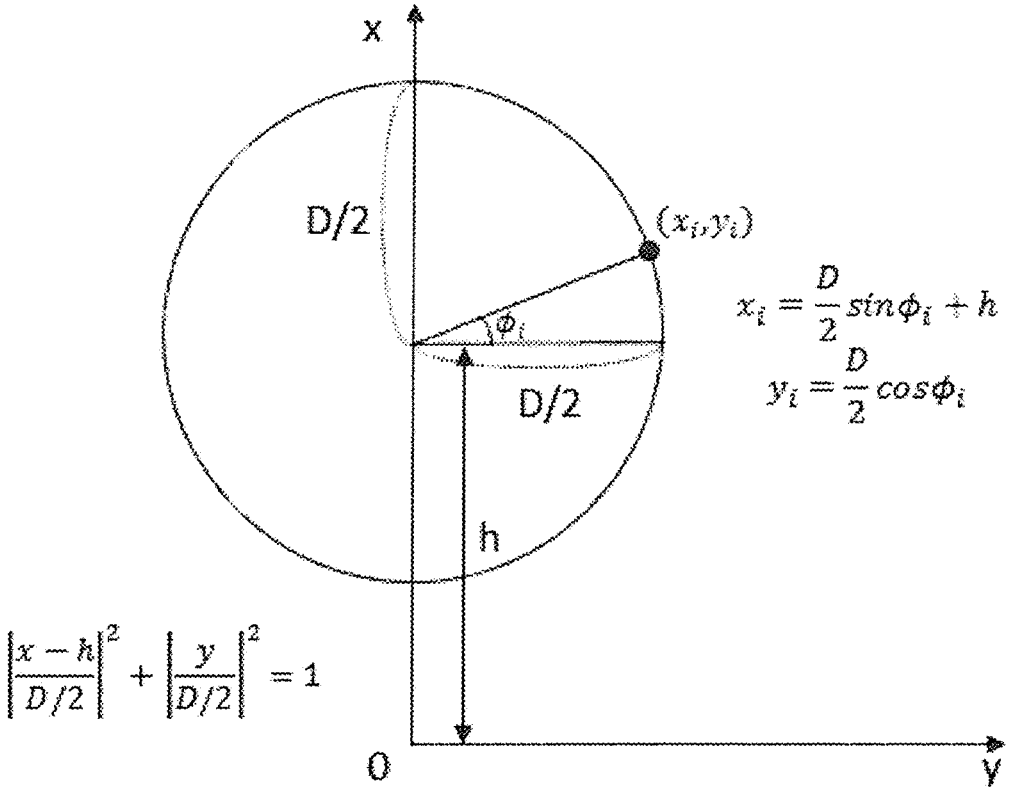
FIG. 1B illustrates a front view of an aperture and a mathematical expression thereof.
Figure 1C:
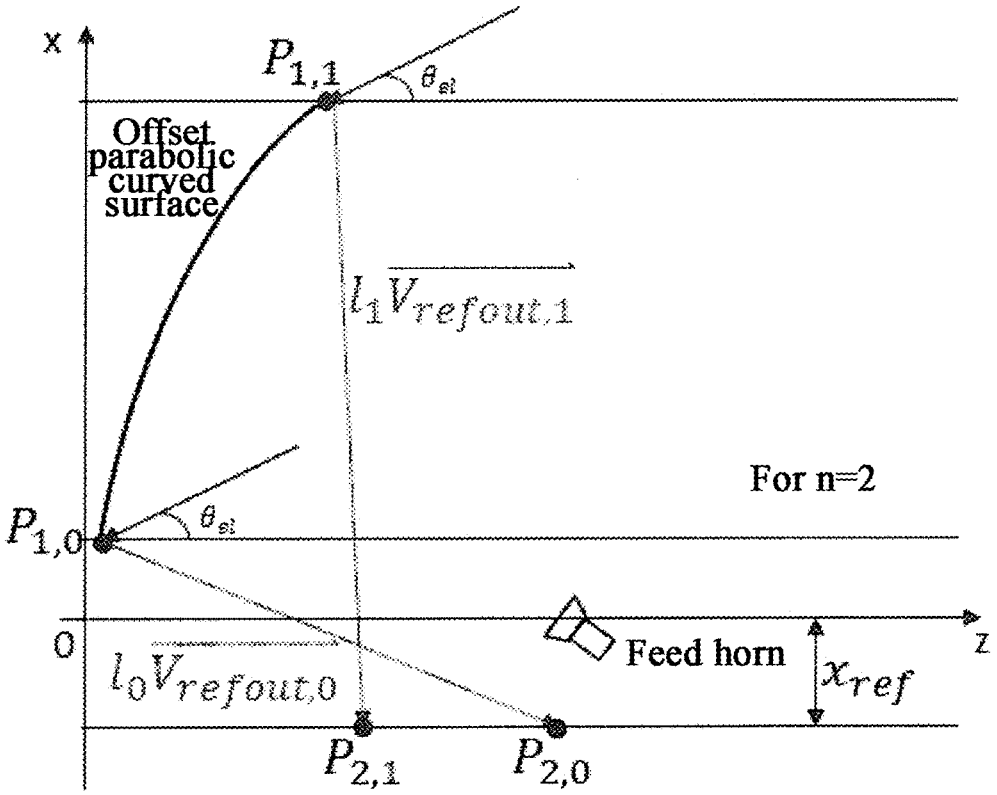
FIG. 1C illustrates a distance between $\overrightarrow{V_{refout,i}}$ and a vector for n=2.

FIG. 1A illustrates a geometry of an offset parabolic antenna according to an example embodiment, FIG. 1B illustrates a front view of an aperture and a mathematical expression thereof, and FIG. 1C illustrates a distance between $\overrightarrow{V_{refout,i}}$ and a vector for n=2.

The embodiments of the present invention provide systems, devices, and methods of designing an antenna device by tracing the influence (e.g., one or more effects) of a sidelobe due to the installation of a horn support pedestal and a radio-frequency (RF) device by a ray tracing method so as to remove the influence of the sidelobe outside a specific angle range. An avoidance area where the influence of the sidelobe is suppressed may be determined based on such a specific angle range. The influence of the sidelobe is not suppressed within the avoidance area. Thus, the influence of the sidelobe may be suppressed by designing the horn support pedestal and the RF device to be located outside of the avoidance area.

According to an example embodiment, the antenna device is configured to include an offset parabolic curved surface 100 having one focal point and in which a height of a midpoint of the offset parabolic curved surface 100 is higher than a height of the focal point, and a feed horn 200 configured to face the offset parabolic curved surface 100 at a preset position.

Further, the antenna device may be configured to further include the horn support pedestal (not illustrated) disposed at a position at which a sidelobe level is designed to be limited to a preset level or less outside the specific angle range. That is, the horn support pedestal and the RF device may be designed to be located outside the avoidance area. Specifically, the avoidance area may be generated using a set of avoidance reference lines of the horn support pedestal according to a desired sidelobe level.

In an example embodiment, the feed horn 200 may be configured to have a first structure that faces the offset parabolic curved surface 100 without a sub-reflector. Alternatively, the feed horn 200 may be configured to have a structure that faces the center of a cassegrain or gregorian sub-reflector, that is, a second structure in which the cassegrain or gregorian sub-reflector faces the center of the offset parabolic curved surface.

In order to determine the avoidance area according to an example embodiment, parameters may be defined as follows. According to an example embodiment, the avoidance area may be calculated according to a focal value as a unique parameter of the offset parametric curved surface, an offset height and a reference avoidance angle.

Referring to FIGS. 1A to 1C, $\ominus_{el}$ is a reference elevation angle, $\ominus_{az}$ is a reference azimuth angle, f is the focal point of the antenna, D is a diameter of an effective aperture, h is a height between the midpoint and the focal point of the antenna, and n is the number of edges of the offset parabolic curved surface. In order to calculate the avoidance area, the edge of the offset parabolic curved surface is defined as Equation 1 below.

$$x_i = \frac{D}{2}\sin\phi_i + h \qquad \text{[Equation 1]}$$

$$y_i = \frac{D}{2}\cos\phi_i$$

$$z_i = (x_i^2 + y_i^2)/(4f)$$

In Equation 1 above, $$\phi_i = \frac{2\pi i}{n}(i = 0, 1, \sim, n-1)$$

is defined, and the angle $\phi_i$ in Equation 1 relates to the aperture and is defined according to the number n of the edges. In this case, the offset parabolic curved surface when viewed from a main radial direction may have a circular shape.

In order to define the avoidance area, Equation 2 below is calculated using the ray tracing technique and Snell's Law with respect to then edges of the parabolic antenna.

$$\overrightarrow{V_{refout,i}} = [-\sin\theta_{el} + 2\alpha_i x_i, -\cos\theta_{el}\sin\theta_{az} + 2\alpha_i y_i, -\cos\theta_{el}\cos\theta_{az} - 4\alpha_i f] \quad \text{[Equation 2]}$$

$$\alpha_i = \frac{2}{4x_i^2 + 4y_i^2 + 16f^2}(2x_i\sin\theta_{el} + 2y_i\cos\theta_{el}\sin\theta_{az} - 4f\cos\theta_{el}\cos\theta_{az})$$

$\overrightarrow{V_{refout,i}}$ defines a vector reflected inward of the reflector according to the reference elevation angle $\Theta_{el}$ and the reference azimuth angle $\Theta_{az}$. The avoidance area may be designated based on $\overrightarrow{V_{refout,i}}$ in Equation 2 is the vector reflected inward of the reflector, which may be drawn using $\overrightarrow{V_{refout,i}}$ as a reference from coordinates on the geometry of the antenna below a ground. The distance $l_i$ of the vector may be calculated along a reference ground $X_{ref}$ by Equation 3 below.

$$l_i=(X_{ref}-X_i)/(V_{refout,i}) \quad \text{Equation 3}$$

By calculating the distance L of the vector along the reference ground $X_{ref}$ and using Equation 4 and $P_{1,i}=[x_i, y_i, z_i]$ below, the avoidance reference line corresponding to the avoidance area may be defined by Equation 5 below.

$$P_{2,i}=[X_i,y_i,z_i]+l_i\overrightarrow{V_{refout,i}} \quad \text{Equation 4}$$

$$L_i=\overline{P_{1,i}P_{2,i}} \quad \text{Equation 5}$$

The avoidance area may be generated using the set of avoidance reference lines along an edge $L_i$ of the offset parabolic curved surface. Specifically, the avoidance area may be generated using the set of avoidance reference lines according to a desired sidelobe level. That is, in a case in which the desired sidelobe level is designed to be −30 dBc or less, or −40 dBc or less in a range of a specific angle θ or more from a main beam, different sets of avoidance reference lines may be generated according to the above specific angle θ and the desired sidelobe level. In another example embodiment, even in a case in which the desired sidelobe level is designed to be linearly decreased (from $SLL_1$ to $SLL_2$) in a specific angle range (θ1 to θ2) from the main beam, different sets of avoidance reference lines may be generated according to the above specific angle range (θ1 to θ2) and the desired sidelobe level ($SLL_1$ to $SLL_2$).

According to an example embodiment, the sidelobe level is not inhibited within the avoidance area. Thus, the horn support pedestal and the RF device may be designed to be located outside the avoidance area.

Figure 2A:
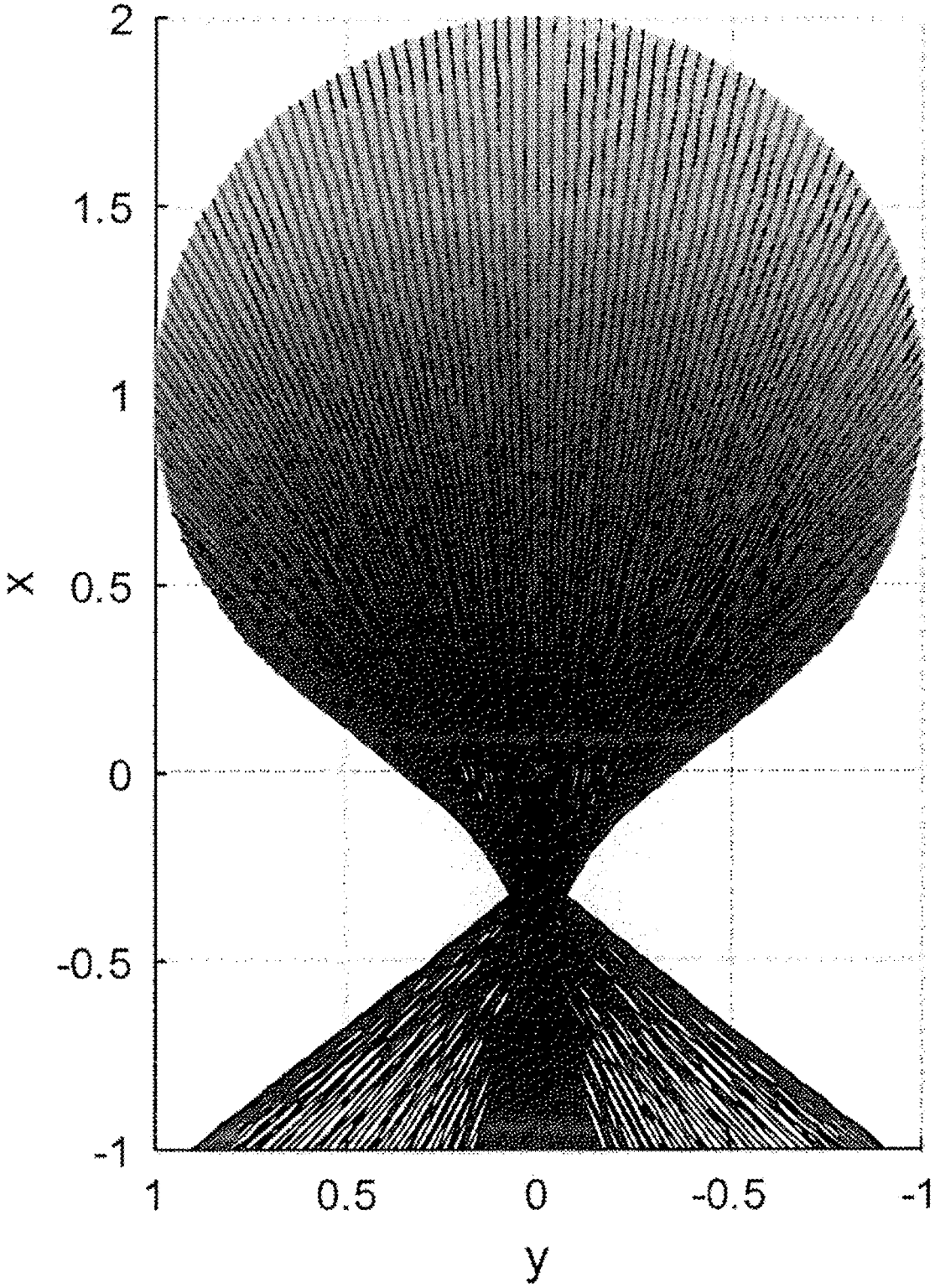
FIGS. 2A to 2C are views visually illustrating an offset parabolic curved surface and an avoidance area for f=1.1, D=2, h=1, m=3, $x_{ref}$=−1, $\ominus_{el}$=13°, and $\ominus_{az}$=0° according to an example embodiment.
Figure 2B:
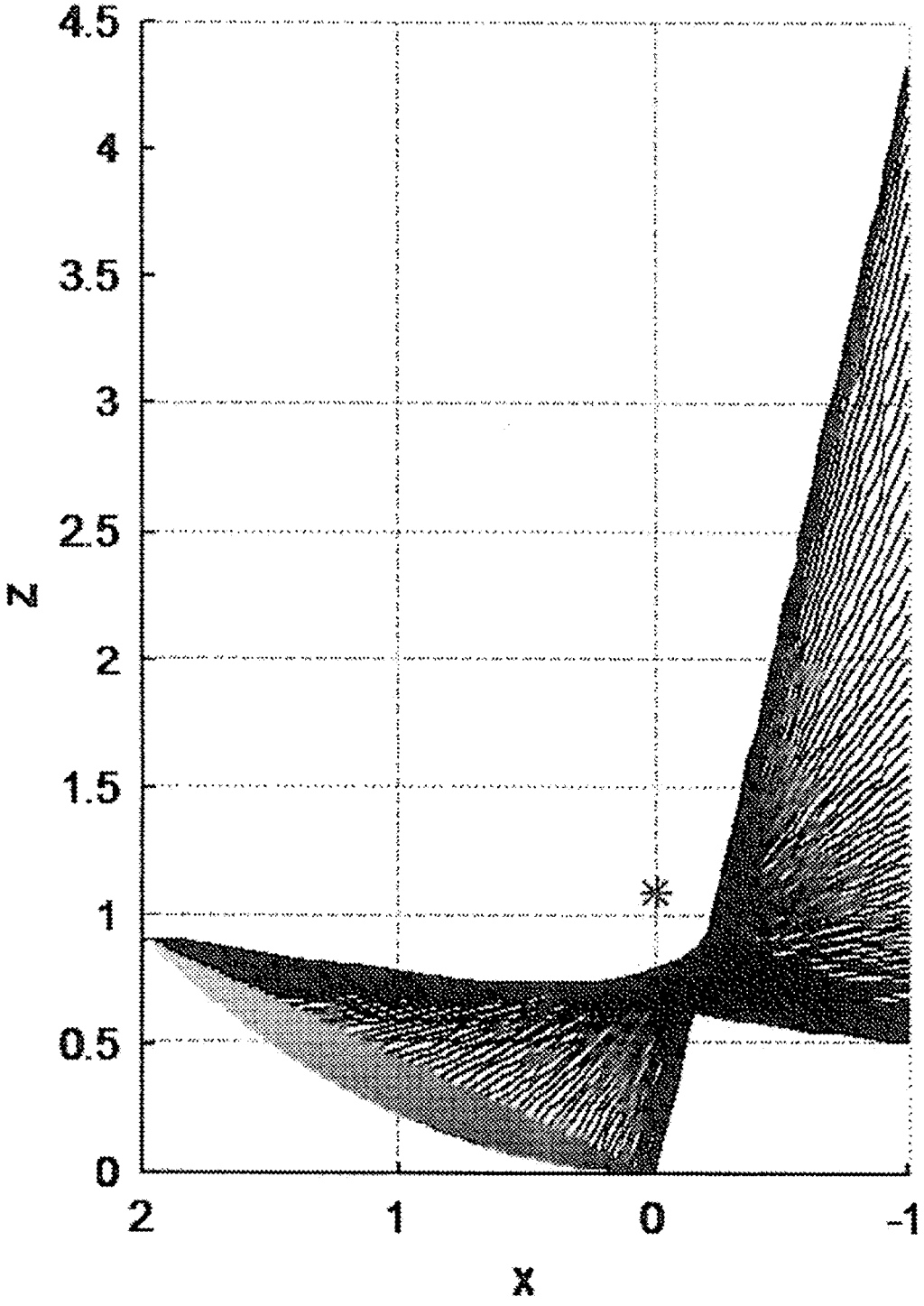
Figure 2C:
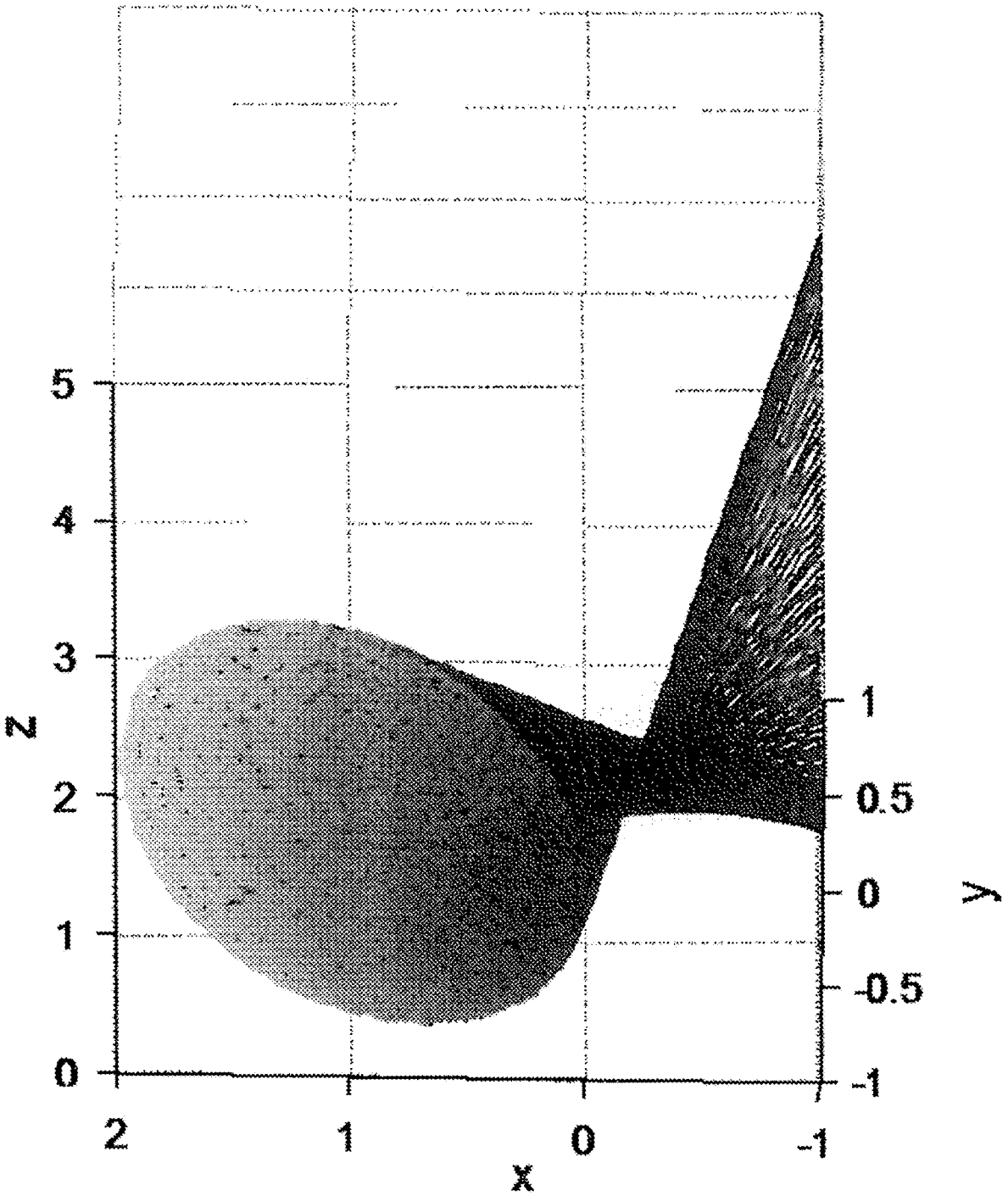

FIGS. 2A to 2C are views visually illustrating the offset parabolic curved surface and the avoidance area for f=1.1, D=2, h=1, m=3, $x_{ref}$=−1, $\Theta_{el}$=13°, and $\Theta_{az}$=0°, according to an example embodiment. Also, referring to FIGS. 1A to 2C, the horn support pedestal (not shown) may be disposed outside the avoidance area. By designing the horn support pedestal and the RF device to be located outside the avoidance area determined in FIGS. 1A to 2C, the influence of the sidelobe on the elevation angle gain pattern may be suppressed.

In another example embodiment, there may be a case in which the RF device needs to be located inside rather than outside the avoidance area depending on an external environment. Even in such a situation, there is a need for a technique that is capable of suppressing the influence of the sidelobe on the elevation angle gain pattern. Hereinafter, an antenna device, which further includes a cover of a specific shape for suppressing the influence of the sidelobe on the elevation angle gain pattern in the situation in which the RF device is located inside the avoidance area, will be described.

Figure 3:
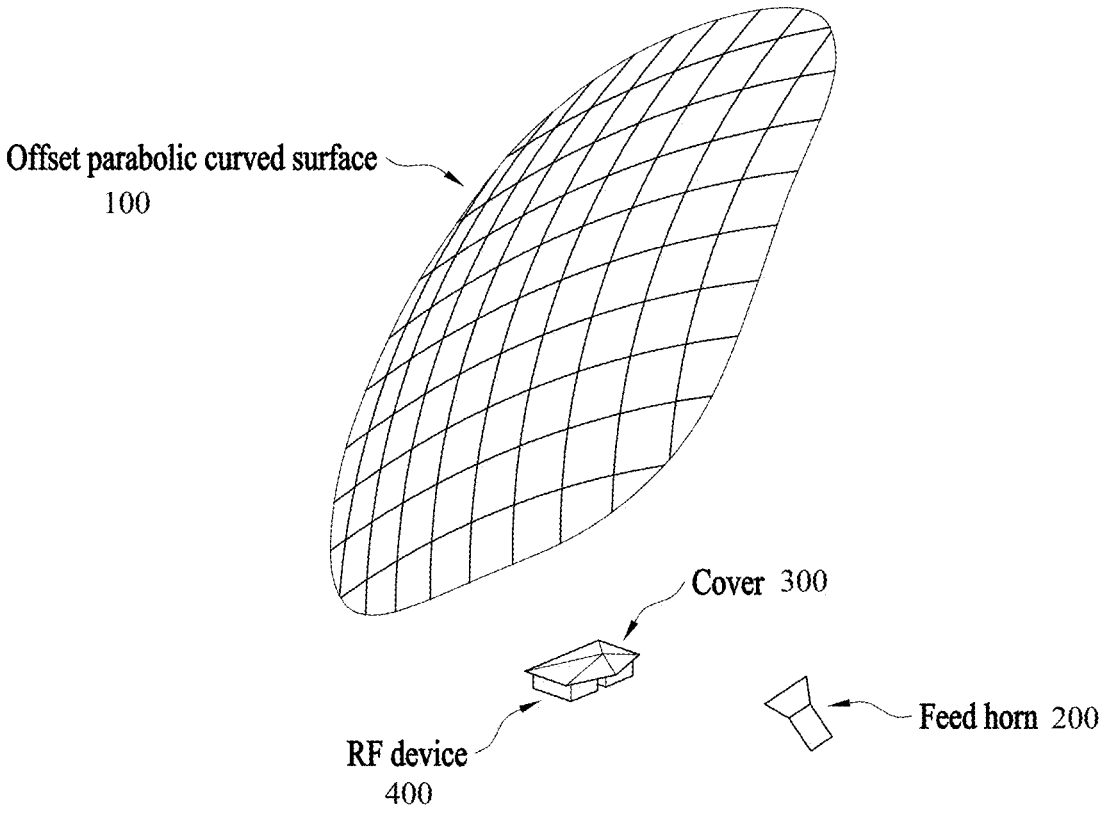
FIG. 3 is a view illustrating an antenna device further including a cover according to an example embodiment.

FIG. 3 is a view illustrating the antenna device further including the cover 300 according to an example embodiment.

Referring to FIG. 3, there is illustrated the antenna device in which the cover 300 is disposed above the RF device 400 when the RF device 400 is installed between the offset parabolic curved surface 100 and the feed horn. According to an example embodiment, by installing the RF device 400 located under the cover 300 of a pentagonal shape between the feed horn 200 and the offset parabolic curved surface 100, it is possible to suppress the sidelobe of the elevation angle gain pattern due to the RF device 400. Specifically, even when the RF device 400 is installed inside rather than outside the avoidance area using the ray tracing technique described with reference to FIGS. 1A to 2C, the sidelobe of the elevation angle gain pattern may be improved due to the cover 300 disposed above the RF device 400. As described above, the cover 300 may have a pentagonal shape. Details of the shape of the cover 300 will be described below with reference to FIG. 4.

Figure 4:
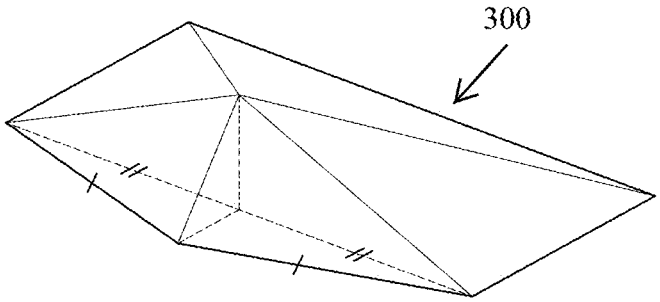
FIG. 4 is a view illustrating a specific structure of the cover according to an example embodiment.

FIG. 4 is a view illustrating a specific structure of the cover 300 according to an example embodiment.

Referring to FIG. 4, the cover 300 may have the pentagonal shape obtained by modifying a hopeless diamond structure. Specifically, a base plane of the cover 300 may have a structure in which a rectangle and an isosceles triangle are coupled to each other. For example, as illustrated in FIG. 4, the cover 300 may have a structure in which one side of the rectangle and one side of the isosceles triangle are shared, and the base plane of the cover 300 may have a pentagonal shape. Further, the cover 300 may have a structure in which vertexes of the pentagon are located at the center of the base line of the isosceles triangle. Specifically, the cover 300 may have a structure in which the vertexes of the pentagon are located at the center of the base line of the isosceles triangle which is shared by the rectangle. Due to the vertexes of the pentagon as described above, rays from the RF device 400 are dispersed or scattered. This suppresses the sidelobe of the elevation angle gain pattern. Heights of the vertexes of the pentagon may be determined based on a size of the base plane. By using the cover 300 configured as above, it is possible to improve the effect of suppressing the sidelobe of the elevation angle gain pattern as illustrated in FIG. 5.

According to an example embodiment, the sidelobe of the elevation angle gain pattern may be improved using the cover 300 regardless of whether the RF device 400 is installed inside or outside the avoidance area. In FIGS. 1A to 2C, the RF device 400 is disposed limitedly outside the avoidance area determined as above. However, in the antenna device that includes the cover 300 having the structure as illustrated in FIG. 4, even if the RF device 400 is disposed inside or outside the avoidance area, the sidelobe of the elevation angle gain pattern may be improved.

Figure 5:
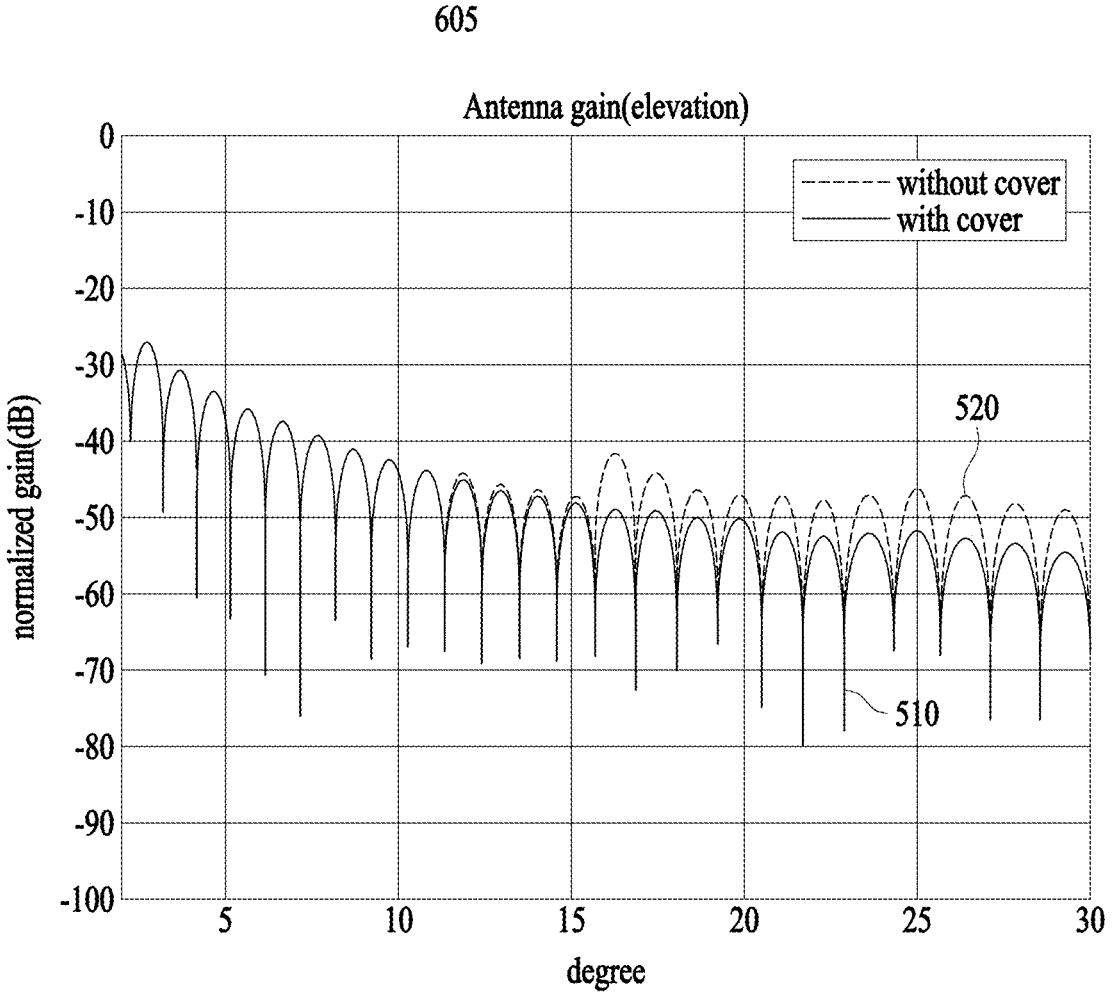
FIG. 5 is a view illustrating results of simulations performed without or with the cover according to an example embodiment.

FIG. 5 is a view illustrating results of simulations performed without or with the cover 300 according to an example embodiment.

Referring to FIG. 5, a first graph trace 510 represents the simulation result of the elevation angle gain pattern in the antenna device including the cover 300, and a second graph trace 520 represents the simulation result of the elevation angle gain pattern in an antenna device including no cover. From the graph trace 510 and the graph trace 520, it is seen that a uniform antenna gain is obtained at various elevations when the antenna device including the cover 300 is used.

Furthermore, the example embodiments described herein could employ related arts for electronic configuration setting, signal processing and/or data processing and the like. The terms "mechanism," "element," "means," and "configuration" are used broadly and are not limited to mechanical or physical embodiments. The above-described example embodiments are merely examples and other example embodiments may be implemented within the scope of the following claims.

It will be apparent to those skilled in the art that various modifications and variations can be made in the antenna device for suppressing a sidelobe of the present invention without departing from the spirit or scope of the invention. Thus, it is intended that the present invention cover the modifications and variations of this invention provided they come within the scope of the appended claims and their equivalents.

What is claimed is:

1. An antenna device comprising:

an offset parabolic curved surface in which a main reflector portion is provided based on a property of the offset parabolic curved surface, in which the offset parabolic curved surface has one focal point, and a height of the focal point is lower than a height of a center of the reflector;

a feed horn provided to face the offset parabolic curved surface at a preset position;

a radio-frequency device is disposed between the offset parabolic curved surface and the feed horn; and a cover having a specific shape and disposed above the radio-frequency device, wherein the specific shape is a pentagonal shape, wherein a base plane of the pentagonal shape has a structure in which a rectangle and an isosceles triangle are coupled to each other.

2. The antenna device of claim 1, wherein vertexes of the pentagonal shape are located at a center of a base line of the isosceles triangle shared by the rectangle.

3. The antenna device of claim 1, wherein the base plane of the pentagonal shape is larger in size than the radio-frequency device.

4. The antenna device of claim 1, wherein the feed horn is configured to face a center of the offset parabolic curved surface without a sub-reflector.

5. The antenna device of claim 1, wherein the radio-frequency device and the cover are located inside a preset avoidance area.

6. The antenna device of claim 5, wherein the cover is configured to suppress a sidelobe of an elevation angle gain pattern which is caused by the radio-frequency device located inside the preset avoidance area.

* * * * *